US007489278B2

(12) United States Patent
Huang

(10) Patent No.: US 7,489,278 B2
(45) Date of Patent: Feb. 10, 2009

(54) MULTI-BAND INVERTED-F ANTENNA

(75) Inventor: Tommy Huang, Taipei (TW)

(73) Assignee: Tyco Electronics Holdings (Bermuda) No. 7 Limited, Pembroke (BM)

( * ) Notice: Subject to any disclaimer, the term of this patent is extended or adjusted under 35 U.S.C. 154(b) by 95 days.

(21) Appl. No.: 11/737,558

(22) Filed: Apr. 19, 2007

(65) Prior Publication Data

US 2007/0247372 A1 Oct. 25, 2007

(30) Foreign Application Priority Data

Apr. 19, 2006 (TW) ..... 95206655 U

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 846, 767, 770
See application file for complete search history.

(56) References Cited

U.S. PATENT DOCUMENTS 6,600,448 B2 7/2003 Ikegaya et al.
6,982,675 B2 * 1/2006 Kwak et al. ..... 343/702
7,119,747 B2 * 10/2006 Lin et al. ..... 343/702
7,289,071 B2 * 10/2007 Hung et al. ..... 343/702
7,324,054 B2 * 1/2008 Ozkar ..... 343/702
7,333,067 B2 * 2/2008 Hung et al. ..... 343/770

* cited by examiner

*Primary Examiner*—Hoang V Nguyen
(74) *Attorney, Agent, or Firm*—Barley Snyder LLC

(57) ABSTRACT

A multi-band inverted-F antenna includes a first high frequency leg; a low frequency leg; a feed, from which the first high frequency leg and the low part are extending; a second high frequency leg, extending along a lengthwise direction of the first high frequency leg from one end of the feed pin a plane orthogonal to that of the first high frequency leg; a regulating part; and a ground, having one end coupled to the feed and a further end coupled to the regulating part. From the surface currents flowing from the feed through the first high frequency leg and the second high frequency leg, the antenna is provided with a multiply widened high-frequency band. Moreover, from the surface currents flowing from the feed, through the regulating part, the lower surface of the regulating part, the lower surface of the first high frequency leg, and the lower surface of the second frequency part, the resistances of the respective first and second high frequency legs of the antenna are regulated to be matched to each other, so that the high frequency leg as a whole of the antenna is operable in a wide-area band.

7 Claims, 5 Drawing Sheets

MULTI-BAND INVERTED-F ANTENNA

CROSS-REFERENCE TO RELATED APPLICATIONS

This application claims the benefit of the filing date under 35 U.S.C. § 119(a)-(d) of Taiwan, R.O.C. Patent Application No. 95206655, filed Apr. 19, 2006.

FIELD OF THE INVENTION

The present invention relates to a multi-band inverted-F antenna, and more particularly, to a multi-band inverted-F antenna that enables the high frequency leg of the antenna to be operated in a wide-area band.

BACKGROUND OF THE INVENTION

In U.S. Pat. No. 6,600,448, a typical inverted-F antenna is disclosed. Such a conventional inverted-F antenna is operable in a single channel, so that the application thereof is limited. FIG. 1 schematically shows another inverted-F antenna. According to the prior art, the antenna includes a feed 11 from which a high frequency leg 1 and a low frequency leg 12 outwardly extend on one end thereof and a ground leg 13 that is coupled to the other end thereof. Such an inverted-F antenna is operable in both high-frequency and low-frequency bands. Nevertheless, the high frequency leg 1 of the antenna is operable only in a narrow band in the dual frequency operation and within the band ranging 5.15 GHz~5.35 GHZ for a wireless network, and ranging 1800 MHz~1900 MHz, for a communication channel. Nowadays, there is an increasing demand on the wide-area band for communication applications and wireless networks. As such, the existing inverted-F antenna needs to be improved.

In order to overcome the mentioned drawbacks of the prior art so as to meet the demand for communication applications and wireless networks, it is desired to provide a novel inverted-F antenna whose high frequency leg thereof is operable in a wide-area band.

SUMMARY OF THE INVENTION

The invention provides a multi-band inverted-F antenna including a first high frequency leg; a low frequency leg; a feed, from which the first high frequency leg and the low part extend; a second high frequency leg, extending along a lengthwise direction of the first high frequency leg from one end of the feed pin in a plane orthogonal to that of the first high frequency leg; a regulating part; and a ground leg, having one end coupled to the feed and a further end coupled to the regulating part.

BRIEF DESCRIPTION OF THE DRAWINGS

The foregoing and other features and advantages of the present invention will be more clearly understood through the following descriptions, with reference to the drawings of which.

DETAILED DESCRIPTION OF THE PREFERRED EMBODIMENT

The invention will now be described more specifically with reference to the following embodiments. It is to be noted that the following descriptions of the embodiments of this invention are presented herein for the purpose of illustration and description only. They are not intended to be exhaustive or to be limited to the precise form disclosed.

Figure 1:
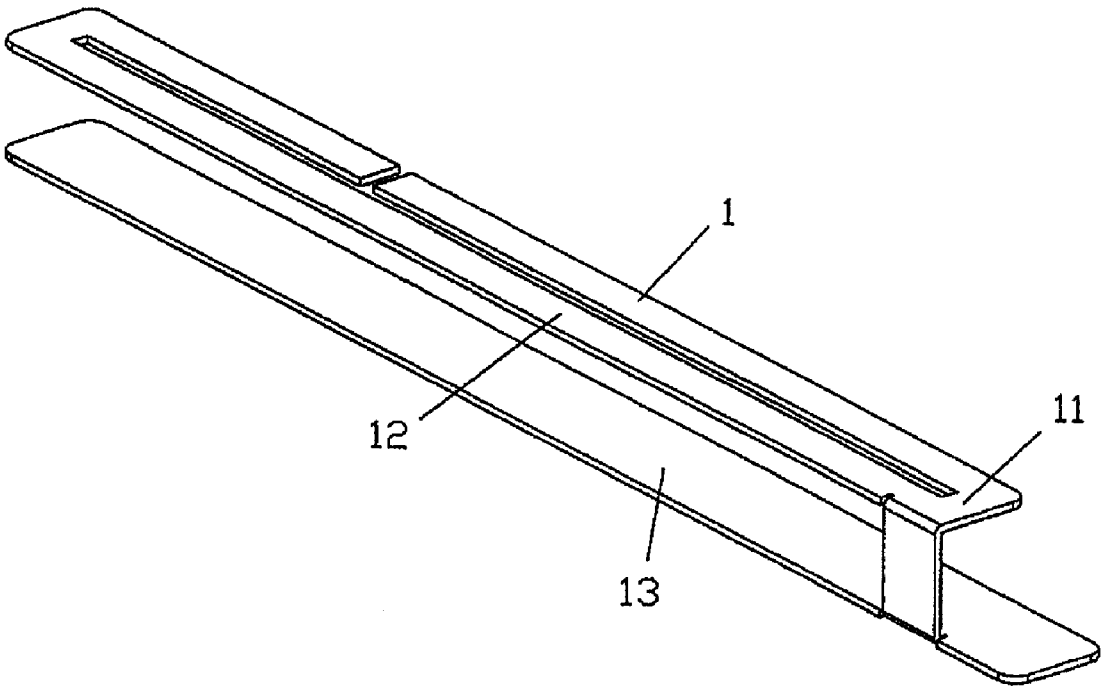
Fig. 1 Prior Art
FIG. 1 is an perspective view schematically showing the conventional inverted-F antenna according to the prior art.
Figure 2:
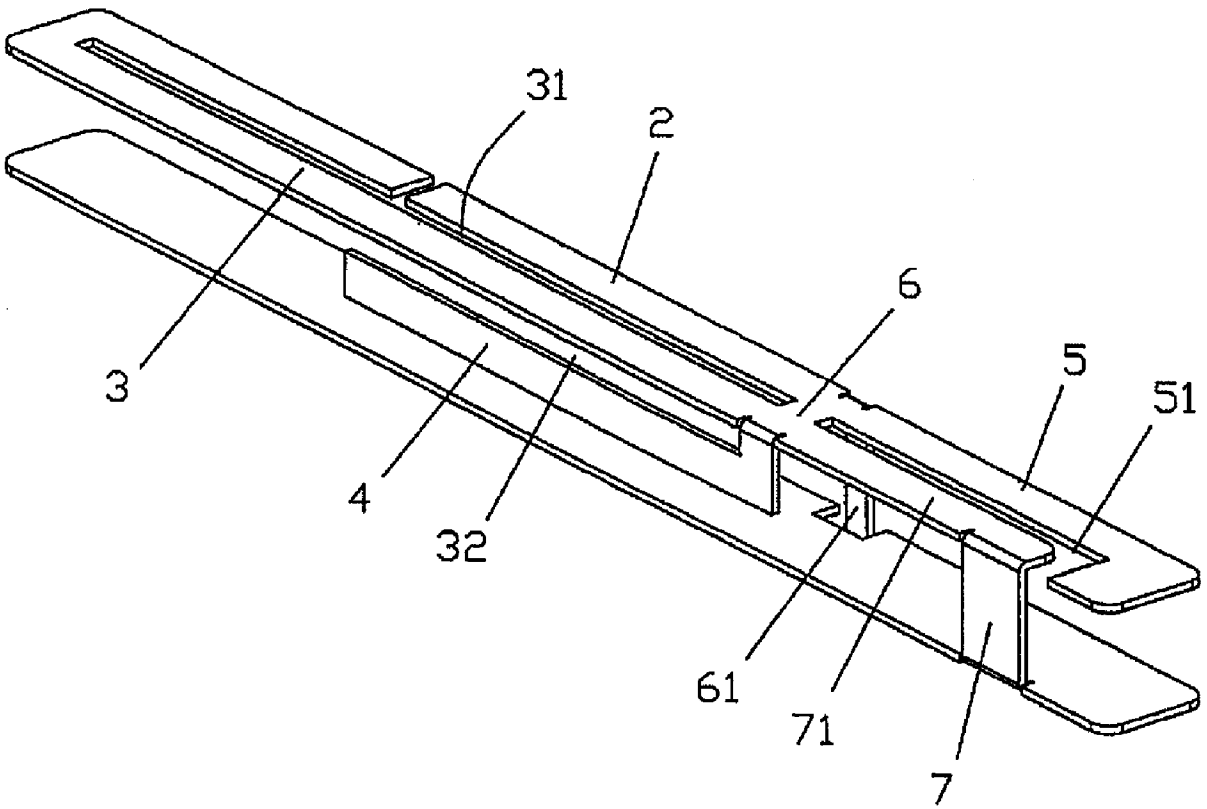
FIG. 2 is a perspective view showing the multi-band inverted-F antenna according to a preferred embodiment of the present invention.
Figure 3:
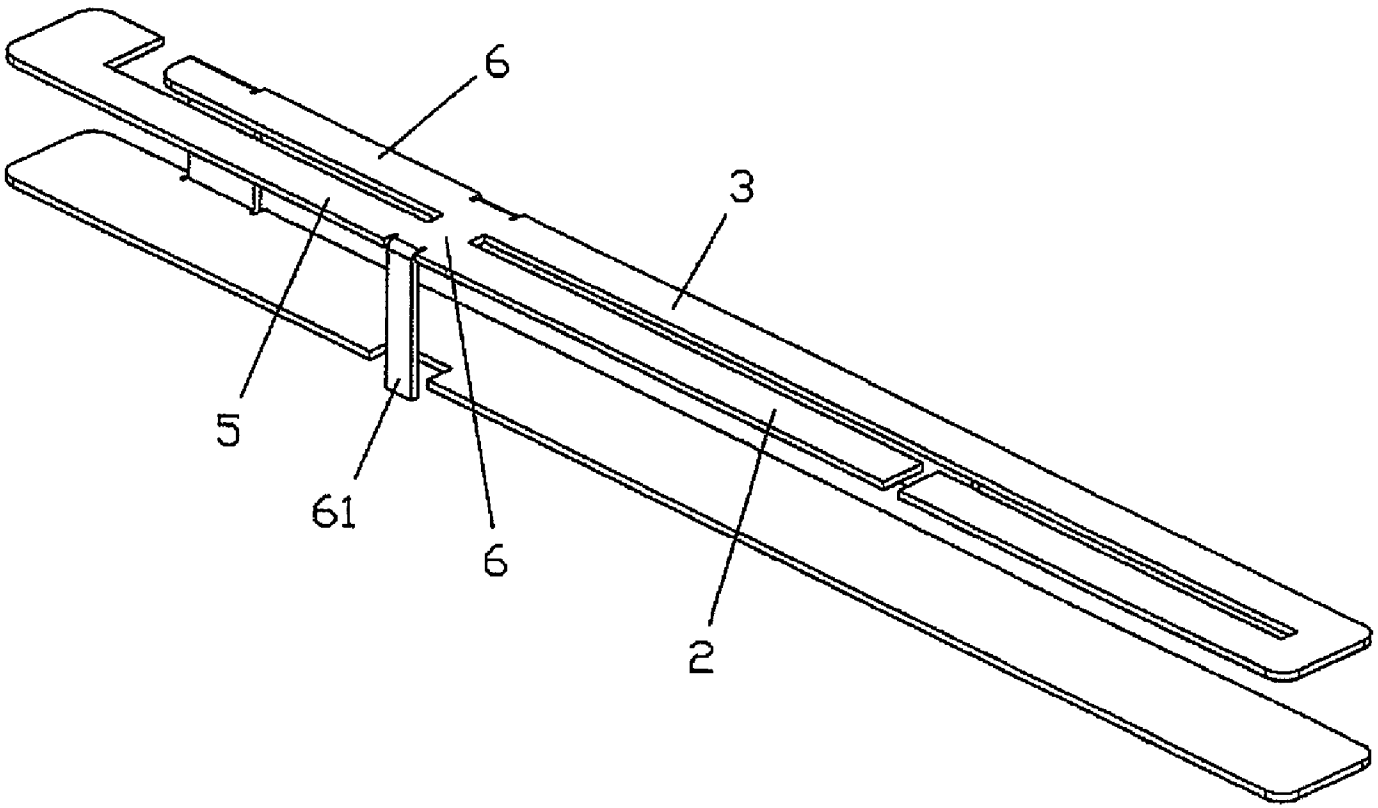
FIG. 3 is a rear perspective view showing the multi-band inverted-F antenna according to the preferred embodiment of the present invention.

With reference to FIGS. 2 and 3, the exemplary multi-band inverted-F antenna of the invention includes a first high frequency leg 2, a low frequency leg 3, a second high frequency leg 4, a regulating part 5, a feed 6 and a ground 7 with a ground leg 71. The first high frequency leg 2 and the low frequency leg 3 are coupled to the feed 6 on one end, and therebetween a T-shaped gap 31 is formed. The second high frequency leg 4 extends along a lengthwise direction of the first high frequency leg 2 from one end of the feed 6 in a plane orthogonal to that of the first high frequency leg 2, and between the second high frequency leg 4 and the low frequency leg 3 a bar-shaped gap 32 is formed. The feed 6 has a feed pin 61 extending therefrom, which is configured for being coupled to a signal transmission line (not shown). The regulating part 5 extends from one end of the feed 6, i.e. the end opposing to that the feed pin 61, the first high frequency leg 2, the low frequency leg 3 and the second high frequency leg 4 extends from, and is coupled thereto with one end of the ground leg 71. Between the regulating part 5 and the ground leg 71, an L-shaped gap 51 is formed.

Figure 4:
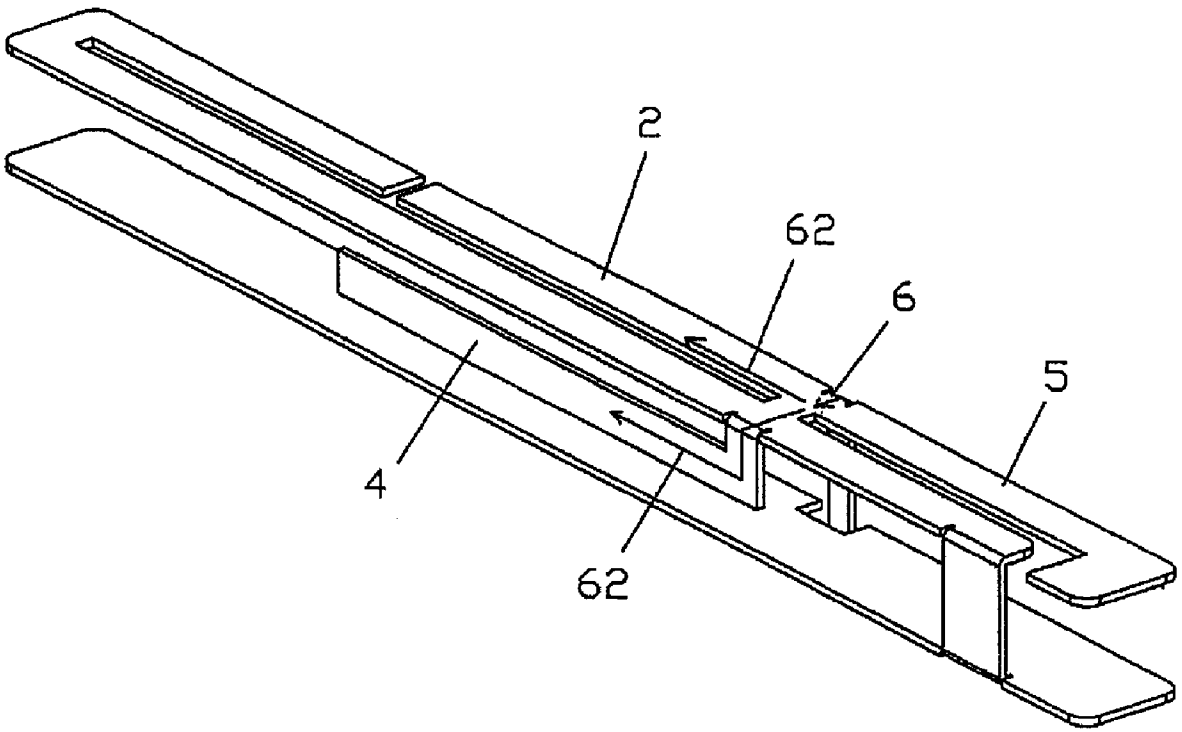
FIG. 4 is a perspective diagram showing the surface currents flowing from the feed part through the first and second high frequency legs of the multi-band inverted-F antenna, according to the preferred embodiment of the present invention.
Figure 5:
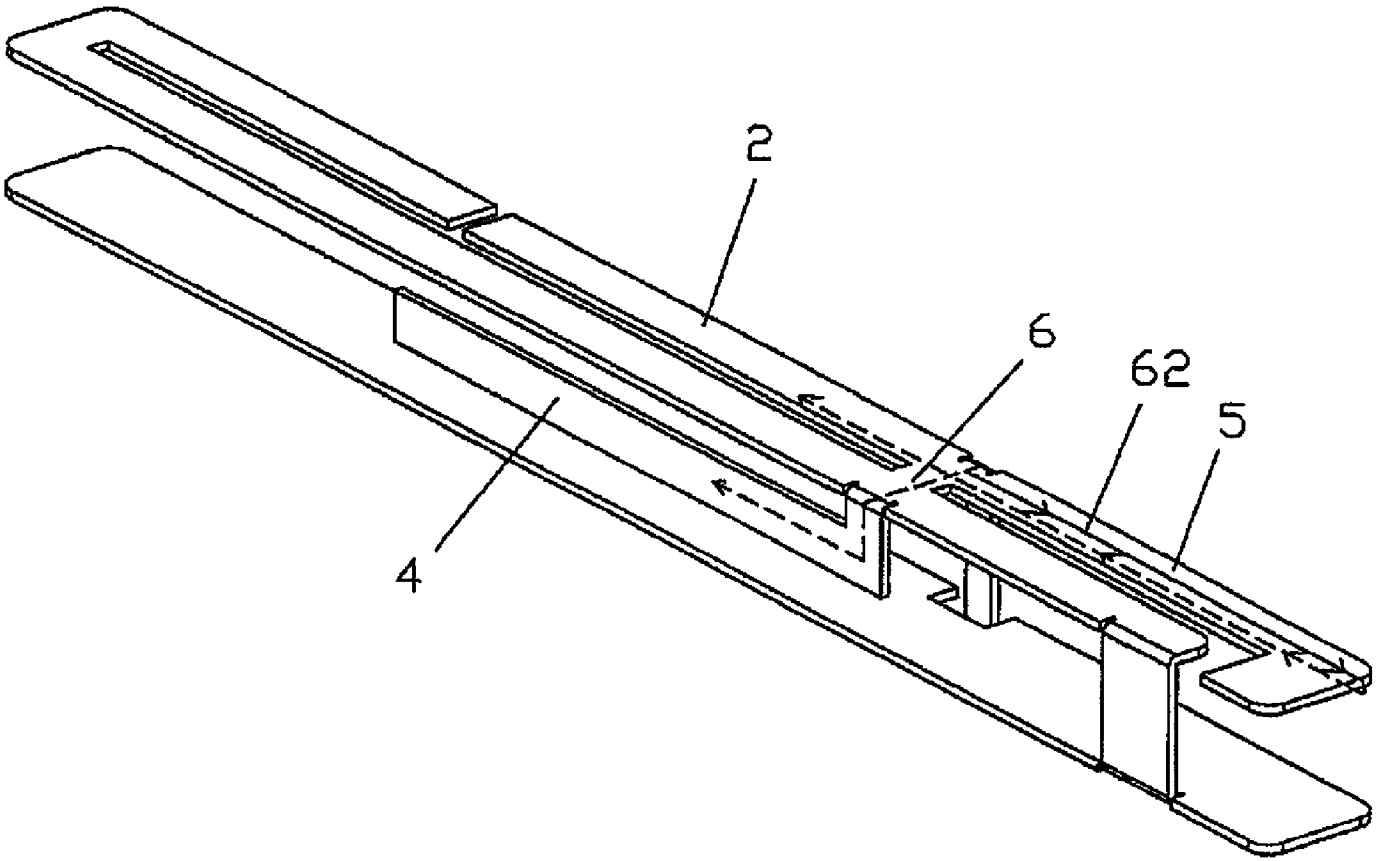
FIG. 5 is a perspective diagram showing the surface currents flowing through the regulating part, the lower surface of the regulating part, the lower surface of the first high frequency leg, and the lower surface of the second frequency part of the multi-band inverted-F antenna according to the preferred embodiment of the present invention.

With reference to FIG. 4, when a signal is received by the antenna, the surface currents of the standing wave thereof 62 would flow from the feed 6 through the first high frequency leg 2 and the second high frequency leg 4, whereby the multi-band inverted-F antenna is provided with a multiply widened high-frequency band. With reference to FIG. 5, by the surface currents 62 flowing from the feed 6, through the regulating part 5, the lower surface of the regulating part 5, the lower surface of the first high frequency leg 2 and the lower surface of the second high frequency leg 4, the resistances of the respective first and second high frequency legs of the antenna are regulated to be matched to each other, so that the high frequency leg as a whole of the antenna is operable in a wide-area band.

The conventional inverted-F antenna is disadvantageous in that the high frequency leg thereof is only operable in a relatively narrow band, e.g. 5.15 GHz~5.35 GHz for wireless networks and 1800 MHz~1900 MHz for communication channels. This limitation fails to meet the demands of communication applications and wireless networks and therefore lacks the industrial utility.

In comparison with the prior art, the multi-band inverted-F antenna of the present invention has a high frequency leg operable in a wide-area band, e.g. 4.9 GHz~5.875 GHz for wireless networks and 1710 MHz~2170 MHz for communication channels, which meets the demands for communication applications and wireless networks.

From surface currents flowing from the feed, through the first high frequency leg and the second high frequency leg, the antenna is advantageously provided with a multiply widened high-frequency band. Moreover, from the surface currents flowing from the feed, through the regulating part, the lower surface of the regulating part, the lower surface of the first high frequency leg, and the lower surface of the second frequency part, the resistances of the respective first and second high frequency legs of the antenna are regulated to be matched to each other, so that the high frequency leg as a whole of the antenna is operable in a wide-area band.

While the invention has been described in terms of an embodiment, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A multi-band inverted-F antenna, comprising:

a first high frequency leg;

a low frequency leg;

a feed from which the first high frequency leg and the low frequency leg extend;

a second high frequency leg extending along a lengthwise direction of the first high frequency leg from one end of the feed in a plane orthogonal to that of the first high frequency leg;

a regulating part; and a ground having one end coupled to the feed and a further end coupled to the regulating part.

2. The multi-band inverted-F antenna of claim 1, wherein the number of the second high frequency legs is at least one.

3. The multi-band inverted-F antenna of claim 1, wherein the number of the regulating parts is at least one.

4. The multi-band inverted-F antenna of claim 1, wherein the feed comprises a feed pin coupled therewith.

5. The multi-band inverted-F antenna of claim 1, having a T-shaped gap formed between the low frequency leg and the first high frequency leg.

6. The multi-band inverted-F antenna of claim 1, having a bar-shaped gap formed between the first high frequency leg and the second high frequency leg.

7. The multi-band inverted-F antenna of claim 1, having an L-shaped gap formed between the regulating part and the ground.

* * * * *